US010260780B2

(12) United States Patent
Li et al.

(10) Patent No.: US 10,260,780 B2
(45) Date of Patent: Apr. 16, 2019

(54) ENHANCED VAPOR INJECTION AIR CONDITIONING SYSTEM

(71) Applicant: GD MIDEA HEATING & VENTILATING EQUIPMENT CO., LTD., Foshan (CN)

(72) Inventors: Hongwei Li, Foshan (CN); Yongfeng Xu, Foshan (CN); Guangpeng Zhang, Foshan (CN); Boqi Liang, Foshan (CN); Yunpeng Jiang, Foshan (CN); Qihui Bu, Foshan (CN); Shilong Dong, Foshan (CN); Xiaohong Wu, Foshan (CN)

(73) Assignee: GD MIDEA HEATING & VENTILATING EQUIPMENT CO., LTD., Foshan (CN)

( * ) Notice: Subject to any disclaimer, the term of this patent is extended or adjusted under 35 U.S.C. 154(b) by 0 days.

(21) Appl. No.: 15/502,018

(22) PCT Filed: Jul. 4, 2016

(86) PCT No.: PCT/CN2016/088434
§ 371 (c)(1),
(2) Date: Feb. 6, 2017

(87) PCT Pub. No.: WO2017/071289
PCT Pub. Date: May 4, 2017

(65) Prior Publication Data

US 2017/0276407 A1 Sep. 28, 2017

(30) Foreign Application Priority Data

Oct. 27, 2015 (CN) ..... 2015 1 0712925
Oct. 27, 2015 (CN) ..... 2015 2 0844824 U

(51) Int. Cl.
*F25B 13/00* (2006.01)
*F25B 1/06* (2006.01)
(Continued)

(52) U.S. Cl.
CPC ..... *F25B 13/00* (2013.01); *F24F 1/10* (2013.01); *F24F 1/16* (2013.01); *F25B 1/06* (2013.01);
(Continued)

(58) Field of Classification Search
CPC ..... F25B 13/00; F25B 49/027; F25B 1/08; F25B 40/02; F25B 1/06; F25B 41/04;
(Continued)

(56) References Cited

U.S. PATENT DOCUMENTS

2004/0134217 A1 7/2004 Itoh et al.
2015/0267930 A1 9/2015 Ryu et al.

FOREIGN PATENT DOCUMENTS

CN 1482425 A 3/2004
CN 202813914 U 3/2013
(Continued)

OTHER PUBLICATIONS

European Patent Application No. 16826276.4 extended Search and Opinion dated Feb. 16, 2018, 8 pages.
(Continued)

*Primary Examiner* — Emmanuel Duke
(74) *Attorney, Agent, or Firm* — Lathrop Gage LLP

(57) ABSTRACT

An enhanced vapor injection air conditioning system is provided and includes: a vapor injection compressor, a direction switching assembly, a first outdoor heat exchanger, a second outdoor heat exchanger including first and second heat-exchange flow passages, and an auxiliary electronic expansion valve assembly. A main electronic expansion valve assembly is connected between a first end of the first
(Continued)

heat-exchange flow passage and a second end of the first outdoor heat exchanger. The auxiliary electronic expansion valve assembly has a first end connected with an inlet of the second heat-exchange flow passage, and a second end connected to a second end of the first heat-exchange flow passage or between the main electronic expansion valve assembly and the first heat-exchange flow passage. A ratio DB of a sum of a caliber of the main electronic expansion valve assembly to that of the auxiliary electronic expansion valve assembly has a range of 1≤DB≤7.

12 Claims, 2 Drawing Sheets

(51) Int. Cl.

| | |
|---|---|
| ***F25B 41/04*** | (2006.01) |
| ***F24F 1/10*** | (2011.01) |
| ***F24F 1/16*** | (2011.01) |
| ***F25B 1/08*** | (2006.01) |
| ***F25B 40/02*** | (2006.01) |

(52) U.S. Cl.
CPC ..... *F25B 1/08* (2013.01); *F25B 40/02* (2013.01); *F25B 41/04* (2013.01); *F25B 2341/0661* (2013.01); *F25B 2400/13* (2013.01); *F25B 2400/23* (2013.01)

(58) Field of Classification Search
CPC ..... F25B 2341/0661; F25B 2400/13; F25B 2400/23; F24F 1/16; F24F 1/10
See application file for complete search history.

(56) References Cited

FOREIGN PATENT DOCUMENTS

| | | | | |
|---|---|---|---|---|
| CN | 103712370 | A | | 4/2014 |
| CN | 203586601 | U | | 5/2014 |
| CN | 204154013 | U | | 2/2015 |
| CN | 204154013 | U | * | 2/2015 |
| CN | 104848578 | A | | 8/2015 |
| CN | 105240957 | A | | 1/2016 |
| CN | 205102288 | U | | 3/2016 |
| DE | 10122000 | A1 | | 11/2002 |
| EP | 2792973 | A1 | | 10/2014 |
| EP | 2843323 | A1 | | 3/2015 |
| JP | 2004177067 | A | | 6/2004 |
| JP | 2006258343 | A | | 9/2006 |
| JP | 2008215697 | A | | 9/2008 |
| JP | 2009127939 | A | | 6/2009 |
| JP | 2014119221 | A | | 6/2014 |
| WO | WO 2014203500 | A1 | | 12/2014 |

OTHER PUBLICATIONS

PCT/CN2016/088434 International search report and Written Opinion dated Oct. 11, 2016, 13 pages.
Chinese Patent Application No. 201510712925.3 First Office Action dated Aug. 3, 2017, 8 pages.
Chinese Patent Application No. 201510712925.3 English translation of First Office Action dated Aug. 3, 2017, 11 pages.
PCT/CN2016/088434 English translation of International Search Report dated Oct. 11, 2016, 3 pages.
Japanese Patent Application No. 2018-513715, English translation of Office Action dated Oct. 2, 2018, 4 pages.
Japanese Patent Application No. 2018-513715, Office Action dated Oct. 2, 2018, 5 pages.

* cited by examiner

ENHANCED VAPOR INJECTION AIR CONDITIONING SYSTEM

RELATED APPLICATIONS

This U.S. application is a U.S. National Phase application of the International Patent Application No. PCT/CN2016/088434, filed Jul. 4, 2016, which claims the benefit of prior Chinese Application No. 201520844824.7 filed Oct. 27, 2015 and No. 201510712925.3 filed Oct. 27, 2015. The entire contents of the before-mentioned patent applications are incorporated by reference as part of the disclosure of this U.S. application.

FIELD

The present invention relates to a vapor-compression refrigeration air-conditioning field, and particularly, to an enhanced vapor injection air conditioning system.

BACKGROUND

According to the related art, an air-conditioning system is more and more widely used, and more and more generally applicable to various workplaces, residences and etc. Also, people have higher and higher requirements for comfort of air conditioners, and especially pay more and more attention to the resulted comfort when heating at low outdoor temperature. However, despite the development of air-conditioning technology, it is inevitable for most air conditioners to encounter a significant reduction of heating effect along with the decrease of the outdoor temperature while heating at low temperature or preparing hot water, thus resulting in a low indoor temperature or a low water-outlet temperature, which degrades the comfort of using air conditioners.

SUMMARY

The present invention aims to solve at least one of the above technical problems in the related art to at least some extent.

Accordingly, embodiments of the present invention provide an enhanced vapor injection air conditioning system that has advantages of a good heating effect and a high energy efficiency of system.

Embodiments of the present invention further provide another enhanced vapor injection air conditioning system that also has advantages of good heating effect and high energy efficiency of system.

According to a first aspect of embodiments of the present invention, an enhanced vapor injection air conditioning system includes: a vapor injection compressor having an air discharge port, an air return port and an injection port; a direction switching assembly having a first valve port, a second valve port, a third valve port and a fourth valve port, in which the first valve port is communicated with one of the second valve port and the third valve port, the fourth valve port is communicated with the other one of the second valve port and the third valve port, the first valve port is connected with the air discharge port, and the fourth valve port is connected with the air return port; a first outdoor heat exchanger having a first end connected with the second valve port; a second outdoor heat exchanger including a first heat-exchange flow passage and a second heat-exchange flow passage configured to exchange heat with each other, in which a main electronic expansion valve assembly is connected in series between a first end of the first heat-exchange flow passage and a second end of the first outdoor heat exchanger, a second end of the first heat-exchange flow passage is connected with an indoor unit system, and an outlet of the second heat-exchange flow passage is connected with the injection port; and an auxiliary electronic expansion valve assembly having a first end connected with an inlet of the second heat-exchange flow passage, and a second end connected to the second end of the first heat-exchange flow passage or connected between the main electronic expansion valve assembly and the first heat-exchange flow passage, in which a ratio DB of a sum of a caliber of the main electronic expansion valve assembly to a sum of a caliber of the auxiliary electronic expansion valve assembly has a value range of $1 \leq DB \leq 7$.

For the enhanced vapor injection air conditioning system according to embodiments of the present invention, by setting a reasonable ratio DB of the sum of the caliber of the main electronic expansion valve assembly to the sum of the caliber of the auxiliary electronic expansion valve assembly, it is possible to enhance the heating effect and the energy efficiency of system greatly, thus making the flow distribution of the system more reasonable, and meanwhile to prevent the system from using a large amount of refrigerant for overcooling and injection, thus avoiding a risk of liquid impact to the system due to the too large injection quantity, which therefore can improve comfort of use by users and reliability of the system operation.

In some embodiments of the present invention, when the enhanced vapor injection air conditioning system has a rated refrigeration capacity of less than 3.6 kW·h, the value range of DB is $1 \leq DB \leq 1.5$; when the enhanced vapor injection air conditioning system has a rated refrigeration capacity of 3.6 kW·h to 5 kW·h, the value range of DB is $1 \leq DB \leq 2$; when the enhanced vapor injection air conditioning system has a rated refrigeration capacity of 5 kW·h to 12 kW·h, the value range of DB is $1.5 \leq DB \leq 2$; when the enhanced vapor injection air conditioning system has a rated refrigeration capacity of 12 kW·h to 16 kW·h, the value range of DB is $1.5 \leq DB \leq 2.2$; when the enhanced vapor injection air conditioning system has a rated refrigeration capacity of 16 kW·h to 20 kW·h, the value range of DB is $1.5 \leq DB \leq 2.5$; when the enhanced vapor injection air conditioning system has a rated refrigeration capacity of 20 kW·h to 25 kW·h, the value range of DB is $1.5 \leq DB \leq 3$; when the enhanced vapor injection air conditioning system has a rated refrigeration capacity of 25 kW·h to 33.5 kW·h, the value range of DB is $1.5 \leq DB \leq 3.5$; when the enhanced vapor injection air conditioning system has a rated refrigeration capacity of 33.5 kW·h to 45 kW·h, the value range of DB is $1.5 \leq DB \leq 4$; when the enhanced vapor injection air conditioning system has a rated refrigeration capacity of 45 kW·h to 67.5 kW·h, the value range of DB is $2 \leq DB \leq 4$; when the enhanced vapor injection air conditioning system has a rated refrigeration capacity of 67.5 kW·h to 78 kW·h, the value range of DB is $2.2 \leq DB \leq 4$; when the enhanced vapor injection air conditioning system has a rated refrigeration capacity of 78 kW·h to 90 kW·h, the value range of DB is $2.2 \leq DB \leq 4.5$.

In some embodiments of the present invention, a ratio SL of a sum of a sectional area of the main electronic expansion valve assembly to a sum of a sectional area of the auxiliary electronic expansion valve assembly has a value range of $1 \leq SL \leq 16$.

In some embodiments of the present invention, when the enhanced vapor injection air conditioning system 100 has a rated refrigeration capacity of less than 3.6 kW·h, the value range of SL is $1 \leq SL \leq 1.5$; when the enhanced vapor injection air conditioning system 100 has a rated refrigeration capacity of 3.6 kW·h to 5 kW·h, the value range of SL is 1≤SL≤2; when the enhanced vapor injection air conditioning system 100 has a rated refrigeration capacity of 5 kW·h to 12 kW·h, the value range of SL is 1≤SL≤2.5; when the enhanced vapor injection air conditioning system 100 has a rated refrigeration capacity of 12 kW·h to 16 kW·h, the value range of SL is 1≤SL≤3; when the enhanced vapor injection air conditioning system 100 has a rated refrigeration capacity of 16 kW·h to 20 kW·h, the value range of SL is 1≤SL≤4; when the enhanced vapor injection air conditioning system 100 has a rated refrigeration capacity of 20 kW·h to 25 kW·h, the value range of SL is 1≤SL≤5; when the enhanced vapor injection air conditioning system 100 has a rated refrigeration capacity of 25 kW·h to 33.5 kW·h, the value range of SL is 1.5≤SL≤6; when the enhanced vapor injection air conditioning system 100 has a rated refrigeration capacity of 33.5 kW·h to 45 kW·h, the value range of SL is 2≤SL≤8; when the enhanced vapor injection air conditioning system 100 has a rated refrigeration capacity of 45 kW·h to 67.5 kW·h, the value range of SL is 3≤SL≤15; when the enhanced vapor injection air conditioning system 100 has a rated refrigeration capacity of 67.5 kW·h to 78 kW·h, the value range of SL is 3.5≤SL≤16; when the enhanced vapor injection air conditioning system 100 has a rated refrigeration capacity of 78 kW·h to 90 kW·h, the value range of SL is 4≤SL≤16.

In some embodiments of the present invention, the main electronic expansion valve assembly includes one main electronic expansion valve or multiple main electronic expansion valves connected in parallel.

In some embodiments of the present invention, the enhanced vapor injection air conditioning system further includes a gas-liquid separator having an inlet connected with the fourth valve port and a gas outlet connected with the air return port.

In some embodiments of the present invention, the outlet of the second heat-exchange flow passage is connected with the air return port, and a block valve is connected in series between the outlet of the second heat-exchange flow passage and the injection port and/or between the outlet of the second heat-exchange flow passage and the air return port.

According to a second aspect of embodiments of the present invention, an enhanced vapor injection air conditioning system includes: a vapor injection compressor having an air discharge port, an air return port and an injection port; a direction switching assembly having a first valve port, a second valve port, a third valve port and a fourth valve port, in which the first valve port is communicated with one of the second valve port and the third valve port, the fourth valve port is communicated with the other one of the second valve port and the third valve port, the first valve port is connected with the air discharge port, and the fourth valve port is connected with the air return port; a first outdoor heat exchanger having a first end connected with the second valve port; a second outdoor heat exchanger including a first heat-exchange flow passage and a second heat-exchange flow passage configured to exchange heat with each other, in which a main electronic expansion valve assembly is connected in series between a first end of the first heat-exchange flow passage and a second end of the first outdoor heat exchanger, a second end of the first heat-exchange flow passage is connected with an indoor unit system, and an outlet of the second heat-exchange flow passage is connected with the injection port; and an auxiliary electronic expansion valve assembly having a first end connected with an inlet of the second heat-exchange flow passage, and a second end connected to the second end of the first heat-exchange flow passage or connected between the main electronic expansion valve assembly and the first heat-exchange flow passage, in which a ratio SL of a sum of a sectional area of the main electronic expansion valve assembly to a sum of a sectional area of the auxiliary electronic expansion valve assembly has a value range of 1≤SL≤16.

For the enhanced vapor injection air conditioning system according to embodiments of the present invention, by setting a reasonable ratio SL of the sum of the sectional area of the main electronic expansion valve assembly to the sum of the sectional area of the auxiliary electronic expansion valve assembly, it is possible to enhance the heating effect and the energy efficiency of system greatly, thus making the flow distribution of the system more reasonable, and meanwhile to prevent the system from using a large amount of refrigerant for overcooling and injection, thus avoiding a risk of liquid impact to the system due to the too large injection quantity, which therefore can improve comfort of use by users and reliability of the system operation.

In some embodiments of the present invention, when the enhanced vapor injection air conditioning system has a rated refrigeration capacity of less than 3.6 kW·h, the value range of SL is 1≤SL≤1.5; when the enhanced vapor injection air conditioning system has a rated refrigeration capacity of 3.6 kW·h to 5 kW·h, the value range of SL is 1≤SL≤2; when the enhanced vapor injection air conditioning system has a rated refrigeration capacity of 5 kW·h to 12 kW·h, the value range of SL is 1≤SL≤2.5; when the enhanced vapor injection air conditioning system has a rated refrigeration capacity of 12 kW·h to 16 kW·h, the value range of SL is 1≤SL≤3; when the enhanced vapor injection air conditioning system has a rated refrigeration capacity of 16 kW·h to 20 kW·h, the value range of SL is 1≤SL≤4; when the enhanced vapor injection air conditioning system has a rated refrigeration capacity of 20 kW·h to 25 kW·h, the value range of SL is 1≤SL≤5; when the enhanced vapor injection air conditioning system has a rated refrigeration capacity of 25 kW·h to 33.5 kW·h, the value range of SL is 1.5≤SL≤6; when the enhanced vapor injection air conditioning system has a rated refrigeration capacity of 33.5 kW·h to 45 kW·h, the value range of SL is 2≤SL≤8; when the enhanced vapor injection air conditioning system has a rated refrigeration capacity of 45 kW·h to 67.5 kW·h, the value range of SL is 3≤SL≤15; when the enhanced vapor injection air conditioning system has a rated refrigeration capacity of 67.5 kW·h to 78 kW·h, the value range of SL is 3.5≤SL≤16; when the enhanced vapor injection air conditioning system has a rated refrigeration capacity of 78 kW·h to 90 kW·h, the value range of SL is 4≤SL≤16.

In some embodiments of the present invention, the main electronic expansion valve assembly includes one main electronic expansion valve or multiple main electronic expansion valves connected in parallel.

In some embodiments of the present invention, the enhanced vapor injection air conditioning system further includes a gas-liquid separator having an inlet connected with the fourth valve port and a gas outlet connected with the air return port.

In some embodiments of the present invention, the outlet of the second heat-exchange flow passage is connected with the air return port, and a block valve is connected in series between the outlet of the second heat-exchange flow passage and the injection port and/or between the outlet of the second heat-exchange flow passage and the air return port.

Additional aspects and advantages of embodiments of present invention will be given in part in the following descriptions, become apparent in part from the following descriptions, or be learned from the practice of the embodiments of the present invention.

Figure 1:
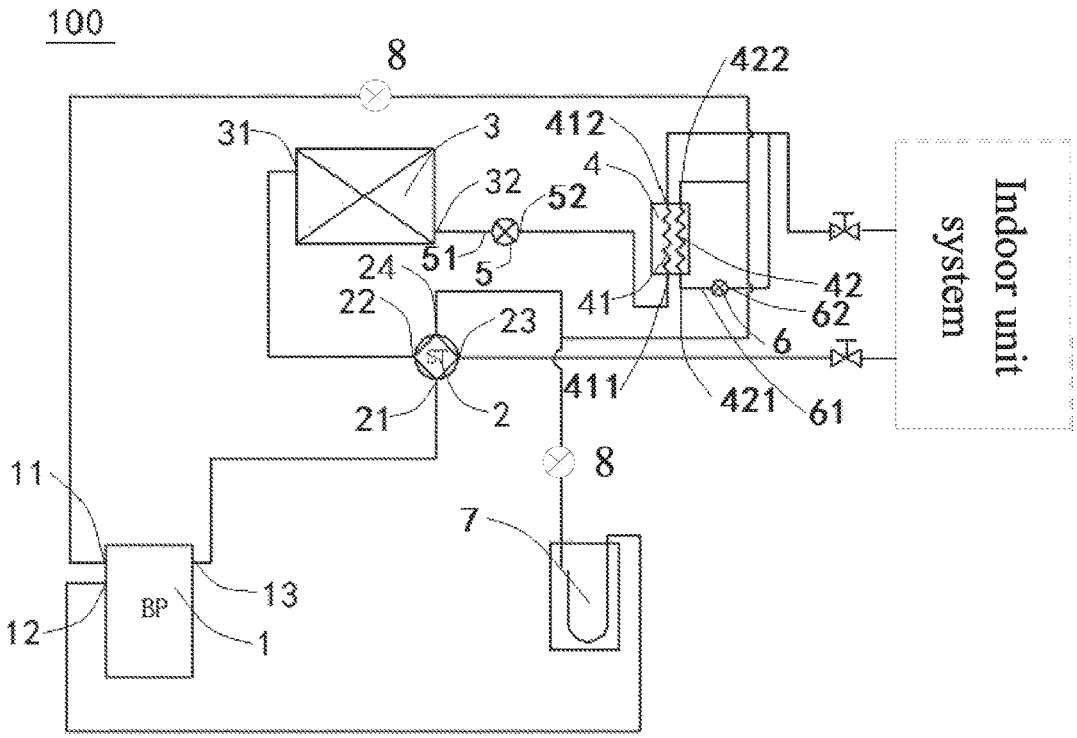
FIG. 1 is a schematic view of an enhanced vapor injection air conditioning system according to an embodiment of the present invention.

REFERENCE NUMERALS enhanced vapor injection air conditioning system 100,
vapor injection compressor 1,
injection port 11, air return port 12, air discharge port 13,
direction switching assembly 2,
first valve port 21, second valve port 22, third valve port 23, fourth valve port 24,
first outdoor heat exchanger 3,
first end 31 of first outdoor heat exchanger, second end 32 of first outdoor heat exchanger,
second outdoor heat exchanger 4,
first heat exchange flow passage 41, first end 411 of first heat exchange flow
passage, second end 412 of first heat exchange flow passage,
second heat exchange flow passage 42, inlet 421 of second heat exchange flow passage, outlet 422 of second heat exchange flow passage,
main electronic expansion valve 5,
first end 51 of main electronic expansion valve, second end 52 of main electronic expansion valve,
auxiliary electronic expansion valve 6,
first end 61 of auxiliary electronic expansion valve, second end 62 of auxiliary electronic expansion valve,
gas-liquid separator 7,
block valve 8.

DETAILED DESCRIPTION

Embodiments of the present invention will be described in detail and examples of the embodiments will be illustrated in the accompanying drawings. The embodiments described herein with reference to the drawings are explanatory, which aim to illustrate the present invention, but shall not be construed to limit the present invention.

In the following, an enhanced vapor injection air conditioning system 100 according to a first aspect of embodiments of the present invention will be described in detail with reference injected into the injection port 11 of the vapor injection compressor 1, so as to increase a heating capacity of the system at a low temperature.

Figure 2:
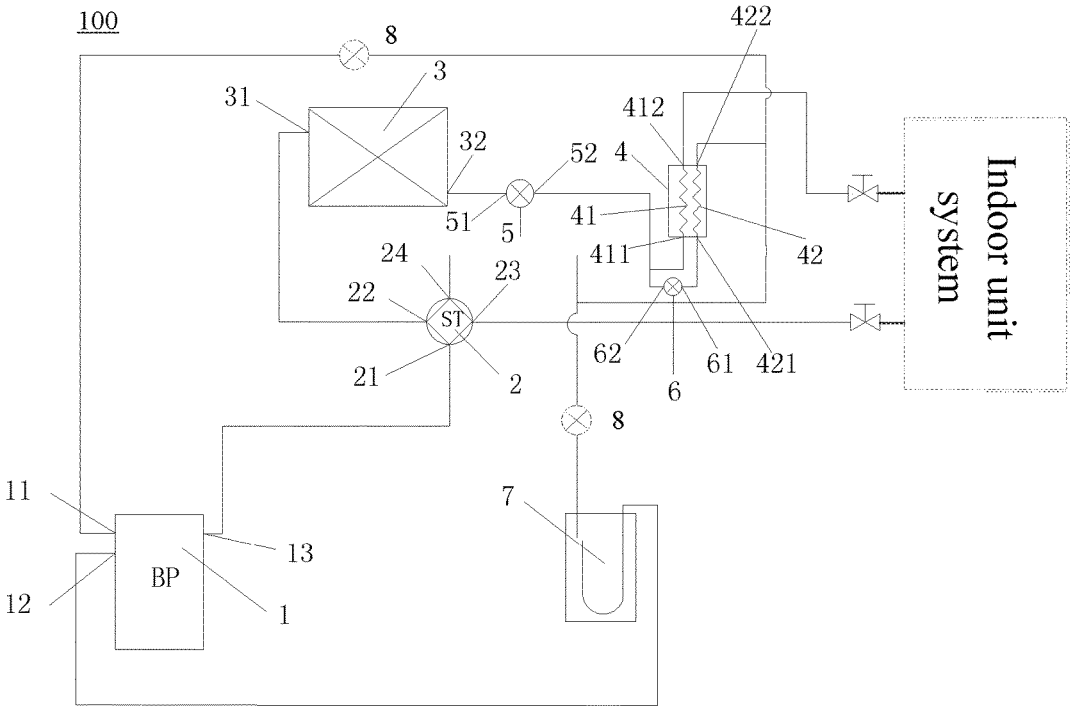
FIG. 2 is a schematic view of an enhanced vapor injection air conditioning system according to another embodiment of the present invention.

The auxiliary electronic expansion valve assembly has a first end (like a first end 61 of an auxiliary electronic expansion valve shown in FIGS. 1 and 2) connected with an inlet 421 of the second heat-exchange flow passage, and a second end connected to the second end 412 of the first heat-exchange flow passage (like a second end 62 of the auxiliary electronic expansion valve shown in FIG. 1) or connected between the main electronic expansion valve assembly and the first heat-exchange flow passage 41 (like a second end 62 of the auxiliary electronic expansion valve shown in FIG. 2).

When the second end of the auxiliary electronic expansion valve assembly (like the second end 62 of the auxiliary electronic expansion valve shown in FIG. 1) is connected to the second end 412 of the first heat-exchange flow passage, and when the enhanced vapor injection air conditioning system 100 is refrigerating, the refrigerant throttled and depressurized through the main electronic expansion valve assembly (like the main electronic expansion valve 5 shown in FIG. 1) enters the first heat-exchange flow passage 41, and the refrigerant discharged from the first heat-exchange flow passage 41 and throttled and depressurized through the auxiliary electronic expansion valve assembly enters the second heat-exchange flow passage 42, such that a temperature difference exists between the first heat-exchange flow passage 41 and the second heat-exchange flow passage 42, and thus the first heat-exchange flow passage 41 and the second heat-exchange flow passage 42 exchange heat with each other.

When the second end of the auxiliary electronic expansion valve assembly is connected to the second end 412 of the first heat-exchange flow passage, and when the enhanced vapor injection air conditioning system 100 is heating, a part of the refrigerant flowing out from the indoor unit is throttled and depressurized by the auxiliary electronic expansion valve assembly, and then enters the second heat-exchange flow passage 42, while another part of the refrigerant flowing out from the indoor unit directly enters the first heat-exchange flow passage 41, such that a temperature difference exists between the first heat-exchange flow passage 41 and the second heat-exchange flow passage 42, and thus the first heat-exchange flow passage 41 and the second heat-exchange flow passage 42 exchange heat with each other. The refrigerant discharged out of the first heat-exchange flow passage 41 is discharged into the first outdoor heat exchanger 3 after being throttled and depressurized by the main electronic expansion valve assembly.

When the second end of the auxiliary electronic expansion valve assembly (like the second end 62 of the auxiliary electronic expansion valve shown in FIG. 2) is connected between the main electronic expansion valve assembly and the first heat-exchange flow passage 41, and when the enhanced vapor injection air conditioning system 100 is refrigerating, a part of the refrigerant throttled and depressurized by the main electronic expansion valve assembly enters the first heat-exchange flow passage 41, and another part of the refrigerant throttled and depressurized by the main electronic expansion valve assembly is throttled and depressurized again by the auxiliary electronic expansion valve assembly and then enters the second heat-exchange flow passage 42, such that a temperature difference exists between the first heat-exchange flow passage 41 and the second heat-exchange flow passage 42, and thus the first heat-exchange flow passage 41 and the second heat-exchange flow passage 42 exchange heat with each other.

When the second end of the auxiliary electronic expansion valve assembly is connected between the main electronic expansion valve assembly and the first heat-exchange flow passage 41, and when the enhanced vapor injection air conditioning system 100 is heating, the refrigerant flowing out from the indoor unit enters the first heat-exchange flow passage 41, and a part of the refrigerant discharged from the first heat-exchange flow passage 41 is throttled and depressurized by the auxiliary electronic expansion valve assembly and then enters the second heat-exchange flow passage 42, such that a temperature difference exists between the first heat-exchange flow passage 41 and the second heat-exchange flow passage 42, and thus the first heat-exchange flow passage 41 and the second heat-exchange flow passage 42 exchange heat with each other. Another part of the refrigerant discharged from the first heat-exchange flow passage 41 is discharged into the first outdoor heat exchanger 3 after being throttled and depressurized by the main electronic expansion valve assembly.

It can be known that the auxiliary electronic expansion valve assembly is provided to ensure the temperature difference between the first heat-exchange flow passage 41 and the second heat-exchange flow passage 42, so that the first heat-exchange flow passage 41 and the second heat-exchange flow passage 42 can exchange heat with each other.

A ratio DB of a sum of a caliber of the main electronic expansion valve assembly to a sum of a caliber of the auxiliary electronic expansion valve assembly has a value range of $1 \leq DB \leq 7$. It should be noted that "caliber" refers to a radius of a valve core of an electronic expansion valve; when the main electronic expansion valve assembly includes a plurality of main electronic expansion valves, the sum of the caliber of the main electronic expansion valve assembly refers to a sum of calibers of the plurality of main electronic expansion valves 5; and when the auxiliary electronic expansion valve assembly includes a plurality of auxiliary electronic expansion valves, the sum of the caliber of the auxiliary electronic expansion valve assembly refers to a sum of calibers of the plurality of auxiliary electronic expansion valves 6. Therefore, it is possible to make a flow distribution of the system reasonable, by reasonably setting the ratio DB of the sum of the caliber of the main electronic expansion valve assembly to the sum of the caliber of the auxiliary electronic expansion valve assembly.

For the enhanced vapor injection air conditioning system 100 according to embodiments of the present invention, by setting a reasonable ratio DB of the sum of the caliber of the main electronic expansion valve assembly to the sum of the caliber of the auxiliary electronic expansion valve assembly, it is possible to enhance the heating effect and the energy efficiency of system greatly, thus making the flow distribution of the system more reasonable, and meanwhile to prevent the system from using a large amount of refrigerant for overcooling and injection, thus avoiding a risk of liquid impact to the system due to the too large injection quantity, which therefore can improve comfort of use by users and reliability of the system operation.

In some embodiments of the present invention, when the enhanced vapor injection air conditioning system 100 has a rated refrigeration capacity of less than 3.6 kW·h, the value range of DB is $1 \leq DB \leq 1.5$; when the enhanced vapor injection air conditioning system 100 has a rated refrigeration capacity of 3.6 kW·h to 5 kW·h, the value range of DB is $1 \leq DB \leq 2$; when the enhanced vapor injection air conditioning system 100 has a rated refrigeration capacity of 5 kW·h to 12 kW·h, the value range of DB is $1.5 \leq DB \leq 2$; when the enhanced vapor injection air conditioning system 100 has a rated refrigeration capacity of 12 kW·h to 16 kW·h, the value range of DB is $1.5 \leq DB \leq 2.2$; when the enhanced vapor injection air conditioning system 100 has a rated refrigeration capacity of 16 kW·h to 20 kW·h, the value range of DB is $1.5 \leq DB \leq 2.5$; when the enhanced vapor injection air conditioning system 100 has a rated refrigeration capacity of 20 kW·h to 25 kW·h, the value range of DB is $1.5 \leq DB \leq 3$; when the enhanced vapor injection air conditioning system 100 has a rated refrigeration capacity of 25 kW·h to 33.5 kW·h, the value range of DB is $1.5 \leq DB \leq 3.5$; when the enhanced vapor injection air conditioning system 100 has a rated refrigeration capacity of 33.5 kW·h to 45 kW·h, the value range of DB is $1.5 \leq DB \leq 4$; when the enhanced vapor injection air conditioning system 100 has a rated refrigeration capacity of 45 kW·h to 67.5 kW·h, the value range of DB is $2 \leq DB \leq 4$; when the enhanced vapor injection air conditioning system 100 has a rated refrigeration capacity of 67.5 kW·h to 78 kW·h, the value range of DB is $2.2 \leq DB \leq 4$; when the enhanced vapor injection air conditioning system 100 has a rated refrigeration capacity of 78 kW·h to 90 kW·h, the value range of DB is $2.2 \leq DB \leq 4.5$.

Therefore, it can be ensured that the enhanced vapor injection air conditioning system 100 has a proper DB value corresponding to the refrigeration capacity of a particular value range, which prevents the system from using a large amount of refrigerant for overcooling and injection, thus avoiding a poor heating effect and a low energy efficiency of system due to a less refrigerant circulation quantity in the system, or avoiding the risk of liquid impact to the system due to a too large injection quantity, so as to improve the heating effect and the energy efficiency of the system.

In some embodiments of the present invention, a ratio SL of a sum of a sectional area of the main electronic expansion valve assembly to a sum of a sectional area of the auxiliary electronic expansion valve assembly has a value range of $1 \leq SL \leq 16$. Thus, it is possible to realize a purpose of further significant increases in heating efficiency and energy efficiency of system, by reasonably setting the ratio SL of the sum of the sectional area of the main electronic expansion valve assembly to the sum of the sectional area of the auxiliary electronic expansion valve assembly. It should be noted that "sectional area" refers to a sectional area of a valve core of an electronic expansion valve; when the main electronic expansion valve assembly includes a plurality of main electronic expansion valves, the sum of the sectional area of the main electronic expansion valve assembly refers to a sum of sectional areas of the plurality of main electronic expansion valves 5; and when the auxiliary electronic expansion valve assembly includes a plurality of auxiliary electronic expansion valves, the sum of the sectional area of the auxiliary electronic expansion valve assembly refers to a sum of sectional areas of the plurality of auxiliary electronic expansion valves 6.

Specifically, when the enhanced vapor injection air conditioning system 100 has a rated refrigeration capacity of less than 3.6 kW·h, the value range of SL is $1 \leq SL \leq 1.5$; when the enhanced vapor injection air conditioning system 100 has a rated refrigeration capacity of 3.6 kW·h to 5 kW·h, the value range of SL is $1 \leq SL \leq 2$; when the enhanced vapor injection air conditioning system 100 has a rated refrigeration capacity of 5 kW·h to 12 kW·h, the value range of SL is $1 \leq SL \leq 2.5$; when the enhanced vapor injection air conditioning system 100 has a rated refrigeration capacity of 12 kW·h to 16 kW·h, the value range of SL is $1 \leq SL \leq 3$; when the enhanced vapor injection air conditioning system 100 has a rated refrigeration capacity of 16 kW·h to 20 kW·h, the value range of SL is $1 \leq SL \leq 4$; when the enhanced vapor injection air conditioning system 100 has a rated refrigeration capacity of 20 kW·h to 25 kW·h, the value range of SL is $1 \leq SL \leq 5$; when the enhanced vapor injection air conditioning system 100 has a rated refrigeration capacity of 25 kW·h to 33.5 kW·h, the value range of SL is $1.5 \leq SL \leq 6$; when the enhanced vapor injection air conditioning system 100 has a rated refrigeration capacity of 33.5 kW·h to 45 kW·h, the value range of SL is $2 \leq SL \leq 8$; when the enhanced vapor injection air conditioning system 100 has a rated refrigeration capacity of 45 kW·h to 67.5 kW·h, the value range of SL is $3 \leq SL \leq 15$; when the enhanced vapor injection air conditioning system 100 has a rated refrigeration capacity of 67.5 kW·h to 78 kW·h, the value range of SL is $3.5 \leq SL \leq 16$; when the enhanced vapor injection air conditioning system 100 has a rated refrigeration capacity of 78 kW·h to 90 kW·h, the value range of SL is 4≤SL≤16.

Therefore, it can be ensured that the enhanced vapor injection air conditioning system 100 has a proper SL value corresponding to the refrigeration capacity of a particular value range, which further prevents the system from using a large amount of refrigerant for overcooling and injection, thus avoiding a poor heating effect and a low energy efficiency of system due to a less refrigerant circulation quantity in the system, or avoiding the risk of liquid impact risk to the system due to a too large injection quantity, so as to further improve the heating effect and the energy efficiency of the system.

In some embodiments of the present invention, the main electronic expansion valve assembly includes one main electronic expansion valve 5, or multiple main electronic expansion valves 5 connected in parallel. For example, as shown in FIG. 1, the main electronic expansion valve assembly is configured as one main electronic expansion valve 5 to facilitate a control over the whole air conditioning system, as a flow adjustment of the main electronic expansion valve assembly may be achieved through adjustments of the caliber or the sectional area of the main electronic expansion valve 5. When the main electronic expansion valve assembly includes multiple main electronic expansion valves 5 connected in parallel, diversity of the adjustment of the main electronic expansion valve assembly may be increased. For example, it is possible to realize the flow adjustment of the main electronic expansion valve assembly by adjusting one, two or more of the multiple main electronic expansion valves 5. Meanwhile one or more of the multiple main electronic expansion valves 5 connected in parallel may be turned off, and the rest thereof may be turned on, such that when the main electronic expansion valve 5 in use is blocked, the rest main electronic expansion valves 5 in a turn-off state may be turned on to realize a normal operation of the system.

In some embodiments of the present invention, the outlet 422 of the second heat-exchange flow passage is connected with the air return port 12, and a block valve 8 may be connected in series between the outlet 422 of the second heat-exchange flow passage and the injection port 11 and/or between the outlet 422 of the second heat-exchange flow passage and the air return port 12. In other words, the second heat-exchange flow passage 42 is connected with the injection port 11 and the air return port 12, and the block valve 8 may be provided between the second heat-exchange flow passage 42 and the injection port 11, or between the second heat-exchange flow passage 42 and the air return port 12, or simultaneously between the second heat-exchange flow passage 42 and the injection port 11 and between the second heat-exchange flow passage 42 and the air return port 12. It should be noted that the block valve 8 serves to enable or cut off circulation of a medium in a pipe, and thus the circulation of the refrigerant between the second heat-exchange flow passage 42 and the injection port 11 and/or between the second heat-exchange flow passage 42 and the air return port 12 may be controlled according to practical requirements. For example, when only the outlet 422 of the second heat-exchange flow passage is in communication with the air return port 12, the air conditioning system has a function of overcooling.

Referring to FIG. 1, the enhanced vapor injection air conditioning system 100 further includes a gas-liquid separator 7 having an inlet connected with the fourth valve port 24 and a gas outlet connected with the air return port 12. The gas-liquid separator 7 may perform a gas-liquid separation to ensure that only gaseous refrigerant may return to the vapor injection compressor 1, thus further avoiding the liquid impact in the vapor injection compressor 1.

An enhanced vapor injection air conditioning system 100 according to a second aspect of embodiments of the present invention will be described with reference to FIG. 1. The enhanced vapor injection air conditioning system 100 includes an outdoor unit and an indoor unit, in which one or more indoor units may be provided.

As shown in FIG. 1, the enhanced vapor injection air conditioning system 100 according to embodiments of the present invention includes a vapor injection compressor 1, a direction switching assembly 2, a first outdoor heat exchanger 3, a second outdoor heat exchanger 4 and an auxiliary electronic expansion valve assembly.

Specifically, the vapor injection compressor 1 has an air discharge port 13, an air return port 12 and an injection port 11. The direction switching assembly 2 has a first valve port 21, a second valve port 22, a third valve port 23, and a fourth valve port 24, in which the first valve port 21 is communicated with one of the second valve port 22 and the third valve port 23, the fourth valve port 24 is communicated with the other one thereof, the first valve port 21 is connected with the air discharge port 13, and the fourth valve port 24 is connected with the air return port 12. The direction switching assembly 2 may be a four-way valve, and certainly it should be understood that the direction switching assembly 2 may be other structures, as long as a direction switching can be realized.

When the enhanced vapor injection air conditioning system 100 is refrigerating, the first valve port 21 is in communication with the second valve port 22, and the third valve port 23 is in communication with the fourth valve port 24. When the enhanced vapor injection air conditioning system 100 is heating, the first valve port 21 is in communication with the third valve port 23, and the second valve port 22 is in communication with the fourth valve port 24.

A first end 31 of the first outdoor heat exchanger is connected with the second valve port 22. The second outdoor heat exchanger 4 includes a first heat-exchange flow passage 41 and a second heat-exchange flow passage 42 that exchange heat mutually, in which a main electronic expansion valve assembly is connected in series between a first end 411 of the first heat-exchange flow passage and a second end 32 of the first outdoor heat exchanger, a second end 412 of the first heat-exchange flow passage is connected with an indoor unit system, and an outlet 422 of the second heat-exchange flow passage is connected with the injection port 11. In such a way, an evaporated refrigerant at the outlet 422 of the second heat-exchange flow passage may be injected into the injection port 11 of the vapor injection compressor 1, so as to increase a heating capacity of the system at a low temperature.

The auxiliary electronic expansion valve assembly has a first end (like a first end 61 of an auxiliary electronic expansion valve shown in FIGS. 1 and 2) connected with an inlet 421 of the second heat-exchange flow passage, and a second end connected to the second end 412 of the first heat-exchange flow passage (like a second end 62 of the auxiliary electronic expansion valve shown in FIG. 1) or connected between the main electronic expansion valve assembly and the first heat-exchange flow passage 41 (like a second end 62 of the auxiliary electronic expansion valve shown in FIG. 2).

When the second end of the auxiliary electronic expansion valve assembly is connected to the second end 412 of the first heat-exchange flow passage, and when the enhanced vapor injection air conditioning system 100 is refrigerating, the refrigerant throttled and depressurized through the main electronic expansion valve assembly enters the first heat-exchange flow passage 41, and the refrigerant discharged from the first heat-exchange flow passage 41 and throttled and depressurized through the auxiliary electronic expansion valve assembly enters the second heat-exchange flow passage 42, such that a temperature difference exists between the first heat-exchange flow passage 41 and the second heat-exchange flow passage 42, and thus the first heat-exchange flow passage 41 and the second heat-exchange flow passage 42 exchange heat with each other.

When the second end of the auxiliary electronic expansion valve assembly is connected to the second end 412 of the first heat-exchange flow passage, and when the enhanced vapor injection air conditioning system 100 is heating, a part of the refrigerant flowing out from the indoor unit is throttled and depressurized by the auxiliary electronic expansion valve assembly, and then enters the second heat-exchange flow passage 42, while another part of the refrigerant flowing out from the indoor unit directly enters the first heat-exchange flow passage 41, such that a temperature difference exists between the first heat-exchange flow passage 41 and the second heat-exchange flow passage 42, and thus the first heat-exchange flow passage 41 and the second heat-exchange flow passage 42 exchange heat with each other. The refrigerant discharged out of the first heat-exchange flow passage 41 is discharged into the first outdoor heat exchanger 3 after being throttled and depressurized by the main electronic expansion valve assembly.

When the second end of the auxiliary electronic expansion valve assembly is connected between the main electronic expansion valve assembly and the first heat-exchange flow passage 41, and when the enhanced vapor injection air conditioning system 100 is refrigerating, a part of the refrigerant throttled and depressurized by the main electronic expansion valve assembly enters the first heat-exchange flow passage 41, and another part of the refrigerant throttled and depressurized by the main electronic expansion valve assembly is throttled and depressurized again by the auxiliary electronic expansion valve assembly and then enters the second heat-exchange flow passage 42, such that a temperature difference exists between the first heat-exchange flow passage 41 and the second heat-exchange flow passage 42, and thus the first heat-exchange flow passage 41 and the second heat-exchange flow passage 42 exchange heat with each other.

When the second end of the auxiliary electronic expansion valve assembly is connected between the main electronic expansion valve assembly and the first heat-exchange flow passage 41, and when the enhanced vapor injection air conditioning system 100 is heating, the refrigerant flowing out from the indoor unit enters the first heat-exchange flow passage 41, and a part of the refrigerant discharged from the first heat-exchange flow passage 41 is throttled and depressurized by the auxiliary electronic expansion valve assembly and then enters the second heat-exchange flow passage 42, such that a temperature difference exists between the first heat-exchange flow passage 41 and the second heat-exchange flow passage 42, and thus the first heat-exchange flow passage 41 and the second heat-exchange flow passage 42 exchange heat with each other. Another part of the refrigerant discharged from the first heat-exchange flow passage 41 is discharged into the first outdoor heat exchanger 3 after being throttled and depressurized by the main electronic expansion valve assembly.

It can be known that the auxiliary electronic expansion valve assembly is provided to ensure the temperature difference between the first heat-exchange flow passage 41 and the second heat-exchange flow passage 42, such that the first heat-exchange flow passage 41 and the second heat-exchange flow passage 42 can exchange heat with each other.

A ratio SL of a sum of a sectional area of the main electronic expansion valve assembly to a sum of a sectional area of the auxiliary electronic expansion valve assembly has a value range of $1 \leq SL \leq 16$. It should be noted that "sectional area" refers to a sectional area of a valve core of an electronic expansion valve; when the main electronic expansion valve assembly includes a plurality of main electronic expansion valves, the sum of the sectional area of the main electronic expansion valve assembly refers to a sum of sectional areas of the plurality of main electronic expansion valves 5; and when the auxiliary electronic expansion valve assembly includes a plurality of auxiliary electronic expansion valves, the sum of the sectional area of the auxiliary electronic expansion valve assembly refers to a sum of sectional areas of the plurality of auxiliary electronic expansion valves 6. Thus, it is possible to make a flow distribution of the system reasonable, by reasonably setting the ratio SL of the sum of the sectional area of the main electronic expansion valve assembly to the sum of the sectional area of the auxiliary electronic expansion valve assembly so as to achieve further significant increases in heating efficiency and energy efficiency of system.

For the enhanced vapor injection air conditioning system 100 according to embodiments of the present invention, by setting a reasonable ratio SL of the sum of the sectional area of the main electronic expansion valve assembly to the sum of the sectional area of the auxiliary electronic expansion valve assembly, it is possible to enhance the heating effect and the energy efficiency of system greatly, thus making the flow distribution of the system more reasonable, and meanwhile to prevent the system from using a large amount of refrigerant for overcooling and injection, thus avoiding a risk of liquid impact to the system due to the too large injection quantity, which therefore can improve comfort of use by users and reliability of the system operation.

In some embodiments of the present invention, when the enhanced vapor injection air conditioning system 100 has a rated refrigeration capacity of less than 3.6 kW·h, the value range of SL is $1 \leq SL \leq 1.5$; when the enhanced vapor injection air conditioning system 100 has a rated refrigeration capacity of 3.6 kW·h to 5 kW·h, the value range of SL is $1 \leq SL \leq 2$; when the enhanced vapor injection air conditioning system 100 has a rated refrigeration capacity of 5 kW·h to 12 kW·h, the value range of SL is $1 \leq SL \leq 2.5$; when the enhanced vapor injection air conditioning system 100 has a rated refrigeration capacity of 12 kW·h to 16 kW·h, the value range of SL is $1 \leq SL \leq 3$; when the enhanced vapor injection air conditioning system 100 has a rated refrigeration capacity of 16 kW·h to 20 kW·h, the value range of SL is $1 \leq SL \leq 4$; when the enhanced vapor injection air conditioning system 100 has a rated refrigeration capacity of 20 kW·h to 25 kW·h, the value range of SL is $1 \leq SL \leq 5$; when the enhanced vapor injection air conditioning system 100 has a rated refrigeration capacity of 25 kW·h to 33.5 kW·h, the value range of SL is $1.5 \leq SL \leq 6$; when the enhanced vapor injection air conditioning system 100 has a rated refrigeration capacity of 33.5 kW·h to 45 kW·h, the value range of SL is $2 \leq SL \leq 8$; when the enhanced vapor injection air conditioning system 100 has a rated refrigeration capacity of 45 kW·h to 67.5 kW·h, the value range of SL is $3 \leq SL \leq 15$; when the enhanced vapor injection air conditioning system 100 has a rated refrigeration capacity of 67.5 kW·h to 78 kW·h, the value range of SL is 3.5≤SL≤16; when the enhanced vapor injection air conditioning system 100 has a rated refrigeration capacity of 78 kW·h to 90 kW·h, the value range of SL is 4≤SL≤16.

Therefore, it can be ensured that the enhanced vapor injection air conditioning system 100 has a proper SL value corresponding to the refrigeration capacity of a particular value range, which prevents the system from using a large amount of refrigerant for overcooling and injection, thus avoiding a poor heating effect and a low energy efficiency of system due to a less refrigerant circulation quantity in the system, or avoiding the risk of liquid impact to the system due to a too large injection quantity, so as to improve the heating effect and the energy efficiency of the system.

In some embodiments of the present invention, the main electronic expansion valve assembly includes one main electronic expansion valve 5 or multiple main electronic expansion valves 5 connected in parallel. For example, as shown in FIG. 1, the main electronic expansion valve assembly is configured as one main electronic expansion valve 5 to facilitate a control over the whole air conditioning system, as a flow adjustment of the main electronic expansion valve assembly may be achieved through adjustments of the caliber or the sectional area of the main electronic expansion valve 5. When the main electronic expansion valve assembly includes multiple main electronic expansion valves 5 connected in parallel, diversity of the adjustment of the main electronic expansion valve assembly may be increased. For example, it is possible to realize the flow adjustment of the main electronic expansion valve assembly by adjusting one, two or more of the multiple main electronic expansion valves 5. Meanwhile one or more of the multiple main electronic expansion valves 5 connected in parallel may be turned off, and the rest thereof may be turned on, such that when the main electronic expansion valve 5 in use is blocked, the rest main electronic expansion valves 5 in a turn-off state may be turned on to realize a normal operation of the system.

In some embodiments of the present invention, the outlet 422 of the second heat-exchange flow passage is connected with the air return port 12, and a block valve 8 is connected in series between the outlet 422 of the second heat-exchange flow passage and the injection port 11 and/or between the outlet 422 of the second heat-exchange flow passage and the air return port 12. In other words, the second heat-exchange flow passage 42 is connected with the injection port 11 and the air return port 12, and the block valve 8 may be provided between the second heat-exchange flow passage 42 and the injection port 11, or between the second heat-exchange flow passage 42 and the air return port 12, or simultaneously between the second heat-exchange flow passage 42 and the injection port 11 and between the second heat-exchange flow passage 42 and the air return port 12. It should be noted that the block valve 8 serves to enable or cut off circulation of a medium in a pipe, and thus the circulation of the refrigerant between the second heat-exchange flow passage 42 and the injection port 11 and/or between the second heat-exchange flow passage 42 and the air return port 12 may be controlled according to practical requirements. For example, when only the outlet 422 of the second heat-exchange flow passage is in communication with the air return port 12, the air conditioning system has a function of overcooling.

In some embodiments of the present invention, referring to FIG. 1, the enhanced vapor injection air conditioning system 100 further includes a gas-liquid separator 7 having an inlet connected with the fourth valve port 24 and a gas outlet connected with the air return port 12. The gas-liquid separator 7 may perform a gas-liquid separation to ensure that only gaseous refrigerant may return to the vapor injection compressor 1, thus further avoiding the liquid impact in the vapor injection compressor 1.

An enhanced vapor injection air conditioning system 100 according to a specific embodiment of the present invention will be described briefly with reference to FIG. 1. The following description is only explanatory and intends to explain the present invention, and shall not be construed to limit the present invention.

As shown in FIG. 1, the enhanced vapor injection air conditioning system 100 according to embodiments of the present invention includes a vapor injection compressor 1, a direction switching assembly 2, a first outdoor heat exchanger 3, a second outdoor heat exchanger 4, a main electronic expansion valve 5, an auxiliary electronic expansion valve 6 and a gas-liquid separator 7.

Specifically, the vapor injection compressor 1 has an air discharge port 13, an air return port 12 and an injection port 11. The direction switching assembly 2 has a first valve port 21, a second valve port 22, a third valve port 23, and a fourth valve port 24, in which the first valve port 21 is connected with one of the second valve port 22 and the third valve port 23, and the fourth valve port 24 is connected with the other one thereof. The second outdoor heat exchanger 4 includes a first heat-exchange flow passage 41 and a second heat-exchange flow passage 42, and the second heat-exchange flow passage 42 has an inlet 421 and an outlet 422.

In the enhanced vapor injection air conditioning system 100, a first end 31 of the first outdoor heat exchanger is connected with the second valve port 22, and a second end 32 of the first outdoor heat exchanger is connected with a first end 51 of the main electronic expansion valve 5. A second end 52 of the main electronic expansion valve 5 is connected with a first end 411 of the first heat-exchange flow passage, and a second end 412 of the first heat-exchange flow passage is connected with an indoor unit. The outlet 422 of the second heat-exchange flow passage is connected with the injection port 11 of the vapor injection compressor 1, and the inlet 421 of the second heat-exchange flow passage is connected with a first end 61 of the auxiliary electronic expansion valve 6. A second end 62 of the auxiliary electronic expansion valve 6 is connected with the second end 412 of the first heat-exchange flow passage. The first valve port 21 is connected with the air discharge port 13, the fourth valve port 24 is connected with the air return port 21, and the gas-liquid separator 7 is disposed in a flow passage between the fourth valve port 24 and the air return port 12.

During operation of the enhanced vapor injection air conditioning system 100, a flow rate of the refrigerant in flow passages of the system may be adjusted by adjusting the calibers or the sectional areas of the main electronic expansion valve 5 and the auxiliary electronic expansion valve 6, so as to enhance the heating effect and the energy efficiency of the system, thus improving the comfort of use by users.

In the specification, it is to be understood that terms such as "central," "longitudinal", "lateral", "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation or the position as then described or as shown in the drawings under discussion. These relative terms are only used to simplify description of the present invention, and do not indicate or imply that the device or element referred to must have a particular orientation, or constructed or operated in a particular orientation. Thus, these terms cannot be constructed to limit the present invention.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples.

Although embodiments of the present invention have been shown and described, it would be appreciated by those skilled in the art that changes, modifications, alternatives and variations can be made in the embodiments without departing from the scope of the present invention. The scope of the present invention is defined by the claims and the like.

What is claimed is:

1. An enhanced vapor injection air conditioning system, comprising:

a vapor injection compressor having an air discharge port, an air return port and an injection port;

a direction switching assembly having a first valve port, a second valve port, a third valve port and a fourth valve port, wherein the first valve port is communicated with one of the second valve port and the third valve port, the fourth valve port is communicated with the other one of the second valve port and the third valve port, the first valve port is connected with the air discharge port, and the fourth valve port is connected with the air return port;

a first outdoor heat exchanger having a first end connected with the second valve port;

a second outdoor heat exchanger comprising a first heat-exchange flow passage and a second heat-exchange flow passage configured to exchange heat with each other, wherein a main electronic expansion valve assembly is connected in series between a first end of the first heat-exchange flow passage and a second end of the first outdoor heat exchanger, a second end of the first heat-exchange flow passage is connected with an indoor unit system, and an outlet of the second heat-exchange flow passage is connected with the injection port; and an auxiliary electronic expansion valve assembly having a first end connected with an inlet of the second heat-exchange flow passage, and a second end connected between the main electronic expansion valve assembly and the first heat-exchange flow passage, wherein a ratio DB of a sum of a caliber of the main electronic expansion valve assembly to a sum of a caliber of the auxiliary electronic expansion valve assembly has a value range of $1 \leq DB \leq 7$.

2. The enhanced vapor injection air conditioning system according to claim 1, wherein when the enhanced vapor injection air conditioning system has a rated refrigeration capacity of less than 3.6 kW·h, the value range of DB is $1 \leq DB \leq 1.5$;

when the enhanced vapor injection air conditioning system has a rated refrigeration capacity of 3.6 kW·h to 5 kW·h, the value range of DB is $1 \leq DB \leq 2$;

when the enhanced vapor injection air conditioning system has a rated refrigeration capacity of 5 kW·h to 12 kW·h, the value range of DB is $1.5 \leq DB \leq 2$;

when the enhanced vapor injection air conditioning system has a rated refrigeration capacity of 12 kW·h to 16 kW·h, the value range of DB is $1.5 \leq DB \leq 2.2$;

when the enhanced vapor injection air conditioning system has a rated refrigeration capacity of 16 kW·h to 20 kW·h, the value range of DB is $1.5 \leq DB \leq 2.5$;

when the enhanced vapor injection air conditioning system has a rated refrigeration capacity of 20 kW·h to 25 kW·h, the value range of DB is $1.5 \leq DB \leq 3$;

when the enhanced vapor injection air conditioning system has a rated refrigeration capacity of 25 kW·h to 33.5 kW·h, the value range of DB is $1.5 \leq DB \leq 3.5$;

when the enhanced vapor injection air conditioning system has a rated refrigeration capacity of 33.5 kW·h to 45 kW·h, the value range of DB is $1.5 \leq DB \leq 4$;

when the enhanced vapor injection air conditioning system has a rated refrigeration capacity of 45 kW·h to 67.5 kW·h, the value range of DB is $2 \leq DB \leq 4$;

when the enhanced vapor injection air conditioning system has a rated refrigeration capacity of 67.5 kW·h to 78 kW·h, the value range of DB is $2.2 \leq DB \leq 4$;

when the enhanced vapor injection air conditioning system has a rated refrigeration capacity of 78 kW·h to 90 kW·h, the value range of DB is $2.2 \leq DB \leq 4.5$.

3. The enhanced vapor injection air conditioning system according to claim 1, wherein a ratio SL of a sum of a sectional area of the main electronic expansion valve assembly to a sum of a sectional area of the auxiliary electronic expansion valve assembly has a value range of $1 \leq SL \leq 16$.

4. The enhanced vapor injection air conditioning system according to claim 3, wherein when the enhanced vapor injection air conditioning system has a rated refrigeration capacity of less than 3.6 kW·h, the value range of SL is 1≤SL≤1.5;

when the enhanced vapor injection air conditioning system has a rated refrigeration capacity of 3.6 kW·h to 5 kW·h, the value range of SL is 1≤SL≤2;

when the enhanced vapor injection air conditioning system has a rated refrigeration capacity of 5 kW·h to 12 kW·h, the value range of SL is 1≤SL≤2.5;

when the enhanced vapor injection air conditioning system has a rated refrigeration capacity of 12 kW·h to 16 kW·h, the value range of SL is 1≤SL≤3;

when the enhanced vapor injection air conditioning system has a rated refrigeration capacity of 16 kW·h to 20 kW·h, the value range of SL is 1≤SL≤4;

when the enhanced vapor injection air conditioning system has a rated refrigeration capacity of 20 kW·h to 25 kW·h, the value range of SL is 1≤SL≤5;

when the enhanced vapor injection air conditioning system has a rated refrigeration capacity of 25 kW·h to 33.5 kW·h, the value range of SL is 1.5≤SL≤6;

when the enhanced vapor injection air conditioning system has a rated refrigeration capacity of 33.5 kW·h to 45 kW·h, the value range of SL is 2≤SL≤8;

when the enhanced vapor injection air conditioning system has a rated refrigeration capacity of 45 kW·h to 67.5 kW·h, the value range of SL is 3≤SL≤15;

when the enhanced vapor injection air conditioning system has a rated refrigeration capacity of 67.5 kW·h to 78 kW·h, the value range of SL is 3.5≤SL≤16;

when the enhanced vapor injection air conditioning system has a rated refrigeration capacity of 78 kW·h to 90 kW·h, the value range of SL is 4≤SL≤16.

5. The enhanced vapor injection air conditioning system according to claim 1, wherein the main electronic expansion valve assembly comprises one main electronic expansion valve or multiple main electronic expansion valves connected in parallel.

6. The enhanced vapor injection air conditioning system according to claim 1, further comprising a gas-liquid separator having an inlet connected with the fourth valve port and a gas outlet connected with the air return port.

7. The enhanced vapor injection air conditioning system according to claim 1, wherein the outlet of the second heat-exchange flow passage is connected with the air return port, and a block valve is connected in series between the outlet of the second heat-exchange flow passage and the injection port and/or between the outlet of the second heat-exchange flow passage and the air return port.

8. An enhanced vapor injection air conditioning system, comprising:

a vapor injection compressor having an air discharge port, an air return port and an injection port;

a direction switching assembly having a first valve port, a second valve port, a third valve port and a fourth valve port, wherein the first valve port is communicated with one of the second valve port and the third valve port, the fourth valve port is communicated with the other one of the second valve port and the third valve port, the first valve port is connected with the air discharge port, and the fourth valve port is connected with the air return port;

a first outdoor heat exchanger having a first end connected with the second valve port;

a second outdoor heat exchanger comprising a first heat-exchange flow passage and a second heat-exchange flow passage configured to exchange heat with each other, wherein a main electronic expansion valve assembly is connected in series between a first end of the first heat-exchange flow passage and a second end of the first outdoor heat exchanger, a second end of the first heat-exchange flow passage is connected with an indoor unit system, and an outlet of the second heat-exchange flow passage is connected with the injection port; and an auxiliary electronic expansion valve assembly having a first end connected with an inlet of the second heat-exchange flow passage, and a second end connected between the main electronic expansion valve assembly and the first heat-exchange flow passage, wherein a ratio SL of a sum of a sectional area of the main electronic expansion valve assembly to a sum of a sectional area of the auxiliary electronic expansion valve assembly has a value range of 1≤SL≤16.

9. The enhanced vapor injection air conditioning system according to claim 8, wherein when the enhanced vapor injection air conditioning system has a rated refrigeration capacity of less than 3.6 kW·h, the value range of SL is 1≤SL≤1.5;

when the enhanced vapor injection air conditioning system has a rated refrigeration capacity of 3.6 kW·h to 5 kW·h, the value range of SL is 1≤SL≤2;

when the enhanced vapor injection air conditioning system has a rated refrigeration capacity of 5 kW·h to 12 kW·h, the value range of SL is 1≤SL≤2.5;

when the enhanced vapor injection air conditioning system has a rated refrigeration capacity of 12 kW·h to 16 kW·h, the value range of SL is 1≤SL≤3;

when the enhanced vapor injection air conditioning system has a rated refrigeration capacity of 16 kW·h to 20 kW·h, the value range of SL is 1≤SL≤4;

when the enhanced vapor injection air conditioning system has a rated refrigeration capacity of 20 kW·h to 25 kW·h, the value range of SL is 1≤SL≤5;

when the enhanced vapor injection air conditioning system has a rated refrigeration capacity of 25 kW·h to 33.5 kW·h, the value range of SL is 1.5≤SL≤6;

when the enhanced vapor injection air conditioning system has a rated refrigeration capacity of 33.5 kW·h to 45 kW·h, the value range of SL is 2≤SL≤8;

when the enhanced vapor injection air conditioning system has a rated refrigeration capacity of 45 kW·h to 67.5 kW·h, the value range of SL is 3≤SL≤15;

when the enhanced vapor injection air conditioning system has a rated refrigeration capacity of 67.5 kW·h to 78 kW·h, the value range of SL is 3.5≤SL≤16;

when the enhanced vapor injection air conditioning system has a rated refrigeration capacity of 78 kW·h to 90 kW·h, the value range of SL is 4≤SL≤16.

10. The enhanced vapor injection air conditioning system according to claim 8, wherein the main electronic expansion valve assembly comprises one main electronic expansion valve or multiple main electronic expansion valves connected in parallel.

11. The enhanced vapor injection air conditioning system according to claim 8, further comprising a gas-liquid separator having an inlet connected with the fourth valve port and a gas outlet connected with the air return port.

12. The enhanced vapor injection air conditioning system according to claim 8, wherein the outlet of the second heat-exchange flow passage is connected with the air return port, and a block valve is connected in series between the outlet of the second heat-exchange flow passage and the injection port and/or between the outlet of the second heat-exchange flow passage and the air return port.

* * * * *